US009212579B2

(12) United States Patent
Han et al.

(10) Patent No.: US 9,212,579 B2
(45) Date of Patent: Dec. 15, 2015

(54) MUFFLER FOR VEHICLE

(71) Applicant: Hyundai Motor Company, Seoul (KR)

(72) Inventors: Hak Son Han, Seongnam-si (KR); Seung Tae Kong, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/462,211

(22) Filed: Aug. 18, 2014

(65) Prior Publication Data

US 2015/0176448 A1 Jun. 25, 2015

(30) Foreign Application Priority Data

Dec. 19, 2013 (KR) ..... 10-2013-0159545

(51) Int. Cl.
*F01N 1/08* (2006.01)

(52) U.S. Cl.
CPC ..... *F01N 1/089* (2013.01)

(58) Field of Classification Search
CPC ..... F01N 1/08; F01N 1/089
USPC ..... 181/272
See application file for complete search history.

(56) References Cited

U.S. PATENT DOCUMENTS 4,381,045 A * 4/1983 Buchwalder ..... 181/265
4,381,832 A * 5/1983 Rauch ..... 181/266
2001/0045322 A1 11/2001 Nilsson et al.
2002/0033304 A1* 3/2002 Watanabe et al. ..... 181/275
2004/0238272 A1* 12/2004 Wan et al. ..... 181/251
2006/0266580 A1* 11/2006 Seiler ..... 181/268
2009/0000863 A1* 1/2009 Kuo ..... 181/256
2009/0145689 A1* 6/2009 Han ..... 181/272

FOREIGN PATENT DOCUMENTS

KR 10-1999-0048065 A 7/1999
KR 10-2005-0017071 A 2/2005
KR 10-2005-0027614 A 3/2005
KR 10-2011-0038509 A 4/2011
KR 10-2012-0008818 A 2/2012

* cited by examiner

*Primary Examiner* — Forrest M Phillips
(74) *Attorney, Agent, or Firm* — Morgan, Lewis & Bockius LLP

(57) ABSTRACT

A muffler for a vehicle, may include a housing which defines a space therein, first and second baffles which partition the space inside the housing into first, second and third chambers, an inlet pipe which extends through the first baffle and the second baffle to be connected to the third chamber through the first chamber and the second chamber, an intermediate pipe which connects between the first and third chambers through the first baffle and the second baffle and has a plurality of holes in a portion thereof which may be placed in the second chamber, and an outlet pipe which sequentially extends through the first baffle and the second baffle from an first open end inside the first chamber, sequentially extends through the second baffle and the first baffle, sequentially extends through the first baffle and the second baffle, and then extends to the outside of the housing.

4 Claims, 4 Drawing Sheets

MUFFLER FOR VEHICLE

CROSS-REFERENCE(S) TO RELATED APPLICATION

The present application claims priority of Korean Patent Application Number 10-2013-0159545 filed on Dec. 19, 2013, the entire contents of which application is incorporated herein for all purposes by this reference.

BACKGROUND OF THE INVENTION

1. Field of the Invention

The present invention relates to a muffler for a vehicle, and more particularly, to a technology for reducing back pressure, enhancing power, and obtaining a sporty sound quality in a low-medium speed range.

2. Description of Related Art

FIGS. 1A and 1B illustrate a conventional exhaust muffler structure for a vehicle. The muffler 502 having a specific volume is disposed on a rear part of an exhaust pipe 500 in order to reduce noise while discharging exhaust gas from an engine to the air.

In addition, a plurality of chambers which are partitioned by a plurality of baffles 504 is provided inside a housing of the muffler 502. An inlet pipe 506 through which exhaust gas enters and an outlet pipe 508 through which the exhaust gas exits are connected to each other through the space inside the housing. With this configuration, the muffler 502 reduces the booming of the exhaust gas through expansion, contraction and interference. As shown in the figure, a variable valve 510 is provided in order to improve the quietness of the vehicle when the engine is idling.

However, the variable valve 510 is relatively expensive, and causes an increase in back pressure in the low-medium speed range, thereby reducing the power of the engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a muffler for a vehicle which reduces cost since an expensive muffler part is not used, and which reduces back pressure while increasing power in a low-medium speed range of an engine and realizes a sporty sound quality through the amplification of C4 and C6 components in the 200 Hz range of exhaust noise.

In an aspect of the present invention, a muffler for a vehicle, may include a housing which defines a space therein, first and second baffles which partition the space inside the housing into first, second and third chambers which are sequentially arranged therein, an inlet pipe which extends from one side of the housing through the first baffle and the second baffle to be connected to the third chamber through the first chamber and the second chamber such that exhaust gas is introduced from outside through the inlet pipe, an intermediate pipe which connects between the first and third chambers through the first baffle and the second baffle and may have a plurality of holes in a portion thereof which is placed in the second chamber, and an outlet pipe which sequentially extends through the first baffle and the second baffle from an first open end inside the first chamber, sequentially extends through the second baffle and the first baffle, sequentially extends through the first baffle and the second baffle, and then extends to the outside of the housing, such that the exhaust gas is discharged to the outside through the outlet pipe.

The inlet pipe may have a plurality of holes in portions thereof which are respectively placed in the first and second chambers.

The outlet pipe linearly extends from one end in the first chamber so as to sequentially extend through the first baffle and the second baffle, is connected to a first U-shaped pipe section inside the third chamber, sequentially extends through the second baffle and the first baffle, is connected to a second U-shaped pipe section inside the first chamber, sequentially extends through the first baffle and the second baffle, and then extends to the outside through the housing.

The outlet pipe may have a plurality of holes in a portion thereof which is exposed inside the third chamber before extending through the housing.

The inlet pipe, the intermediate pipe and the outlet pipe are configured such that the portions of the inlet and intermediate pipes which are placed in the first and second baffles are arranged parallel to each other, the first open end of the outlet pipe and the holes of the inlet pipe are disposed inside the first chamber at positions which are spatially separated from each other by the second U-shaped pipe section of the outlet pipe, and a first open end of the inlet pipe and the holes of the outlet pipe are disposed inside the third chamber so as to be adjacent to each other without an obstacle spatially.

As set forth above, it is possible to reduce cost since an expensive muffler part is not used, reduce back pressure while increasing power in a low-medium speed range of an engine, and realize a sporty sound quality through the amplification of C4 and C6 components in the 200 Hz range of exhaust noise.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1A:
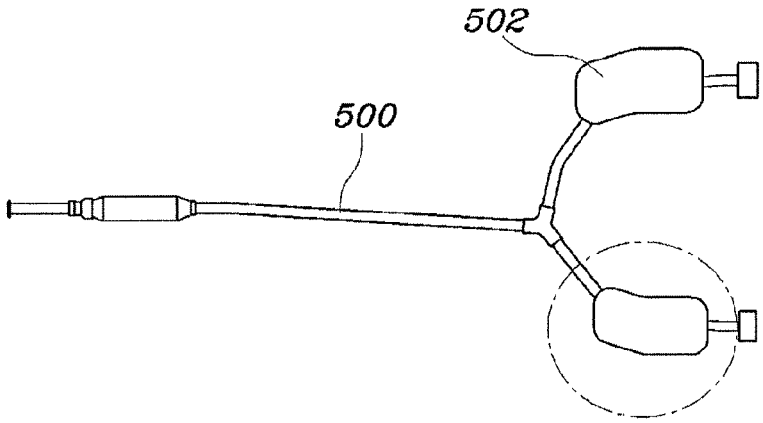
FIG. 1A (Related Art)
FIGS. 1A and 1B are views illustrating the structure of a conventional muffler.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

Reference will now be made in greater detail to an exemplary embodiment of the present invention, an example of which is illustrated in the accompanying drawings. Wherever possible, the same reference numerals will be used throughout the drawings and the description to refer to the same or like parts.

Figure 2:
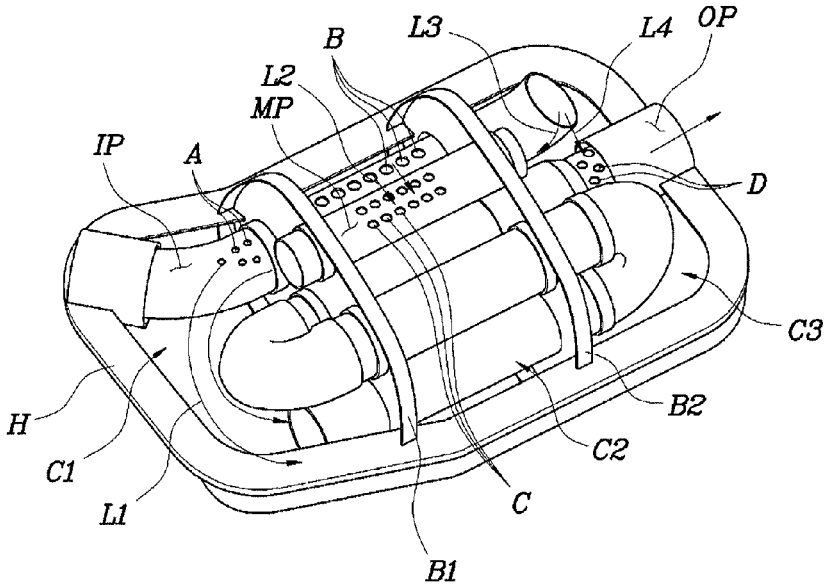
FIG. 2 is a view showing the structure of a muffler for a vehicle according to an exemplary embodiment of the invention.
Figure 3:
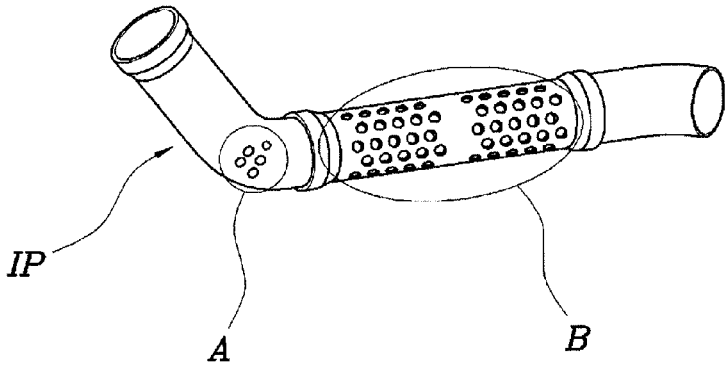
FIG. 3 is a detailed view showing an inlet pipe shown in FIG. 2.
Figure 4:
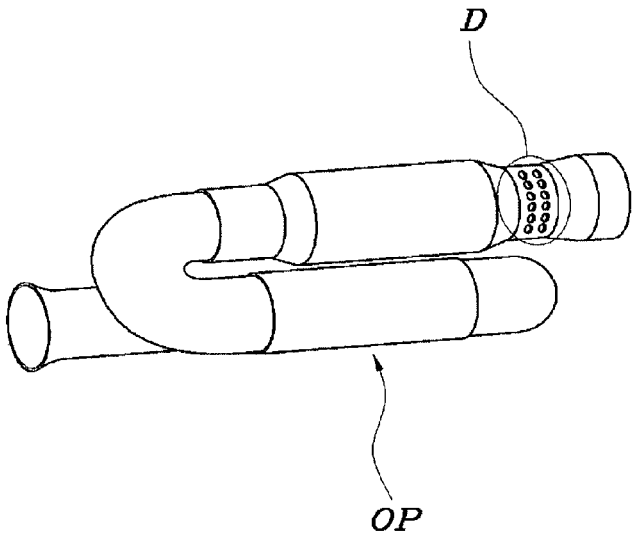
FIG. 4 is a detailed view showing an outlet pipe shown in FIG. 2.

Referring to FIG. 2 to FIG. 4, a muffler for a vehicle according to an exemplary embodiment of the invention includes: a housing H which defines a space therein, first and second baffles B1 and B2 which partition the space inside the housing H into first, second and third chambers C1, C2 and C3 which are sequentially arranged, an inlet pipe IP which extends from one side of the housing H through the first baffle B1 and the second baffle B2 to be connected to the third chamber C3 through the first chamber C1 and the second chamber C2 such that exhaust gas is introduced from the outside through the inlet pipe IP, an intermediate pipe MP which connects between the first and third chambers C1 and C2 through the first baffle B1 and the second baffle B2 and has a plurality of holes C in a portion thereof which passes through the second chamber C2, and an outlet pipe OP which sequentially extends through the first baffle B1 and the second baffle B2 from one open end inside the first chamber C1, sequentially extends through the second baffle B2 and the first baffle B1, sequentially extends through the first baffle B1 and the second baffle B2, and then extends to the outside of the housing H, such that the exhaust gas is discharged through the outlet pipe OP.

The muffler according to the present exemplary embodiment forms the three chambers C1 to C3, which are arranged in the direction from the inlet side to the outlet side, using the first and second baffles B1 and B2. The inlet pipe IP extends from one side of the housing H through the chambers C1 to C3, more particularly, sequentially in the direction from the first chamber C1 to the third chamber C3. The outlet pipe OP extends from the first chamber C1 to the third chamber C3 two times so as to form a long passage and communicates with the outside beyond the third chamber C3, such that the exhaust gas can be discharged through the outlet pipe OP to the outside. The intermediate pipe MP allows the first, second and third chambers C1, C2 and C3 to communicate with each other.

The inlet pipe IP has a plurality of holes A in a portion thereof which passes through the first chamber C1 and a plurality of holes B in a portion thereof which passes through the second chamber C2.

The outlet pipe OP linearly extends from one end in the first chamber C1 so as to sequentially extend through the first baffle B1 and the second baffle B2, is connected to a first U-shaped pipe section inside the third chamber C3, sequentially extends through the second baffle B2 and the first baffle B1, is connected to a second U-shaped pipe section inside the first chamber C1, sequentially extends through the first baffle B1 and the second baffle B2, and then extends to the outside through the housing H.

In addition, the outlet pipe OP has a plurality of holes D in a portion thereof which is exposed inside the third chamber C3 before extending through the housing H.

Referring to the structure of the inlet pipe IP, the intermediate pipe MP and the outlet pipe OP, the portions of the pipes IP, MP and OP which pass through the first and second baffles B1 and B2 are arranged parallel to each other, one opened end of the outlet pipe OP and the holes A of the inlet pipe IP are disposed inside the first chamber C1 at positions which are spatially separated from each other by the U-shaped pipe of the outlet pipe OP. One open end of the inlet pipe IP and the holes D of the outlet pipe OP are disposed inside the third chamber C3 so as to be adjacent to each other without any obstacle spatially.

In the above-described muffler according to this embodiment, the two U-shaped pipes of the outlet pipe OP provide a long-tail pipe structure which increases the length as long as possible. It is therefore possible to effectively reduce a C2 booming component that is a default order of exhaust noise.

Figure 5:
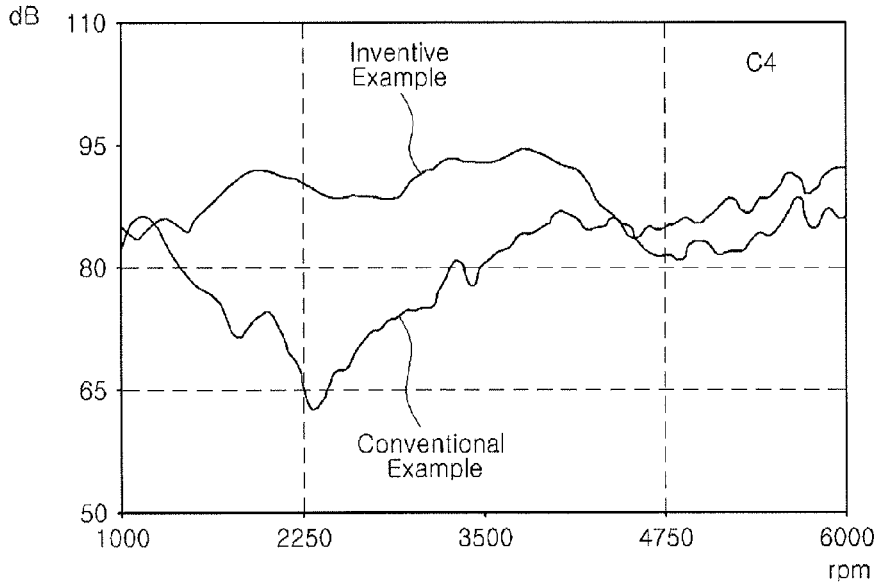
FIG. 5 is a graph comparing the effect of the amplification of C4 component of exhaust noise of an inventive example with that of a conventional example.
Figure 6:
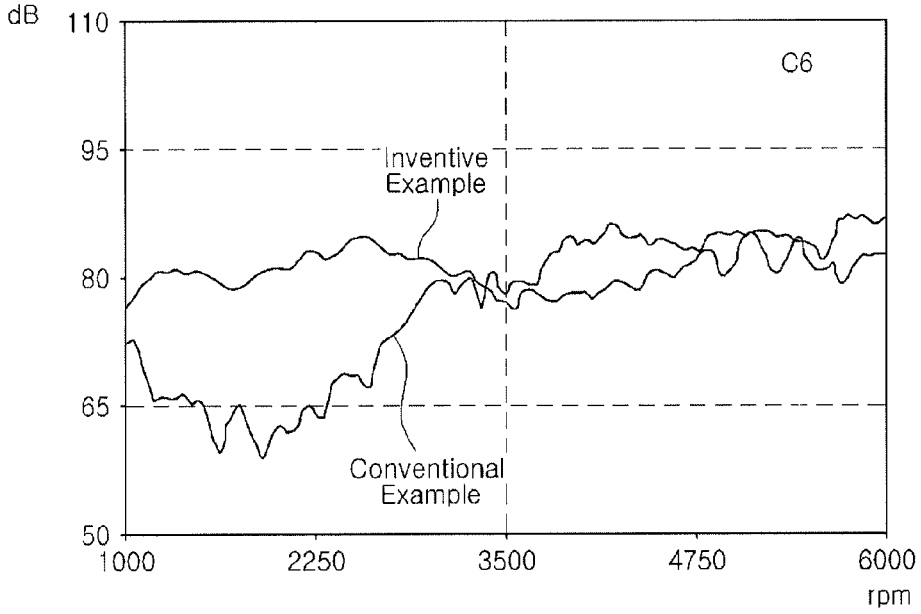
FIG. 6 is a graph comparing the effect of the amplification of C6 component of exhaust noise of an inventive example with that of a conventional example.

In addition, the holes D in the outlet pipe OP form a flow path adjacent to the inlet pipe IP inside third chamber C3, thereby serving to increase C4 and C6 components in available number-of-revolutions ranges shown in FIG. 5 and FIG. 6.

Figure 1B:
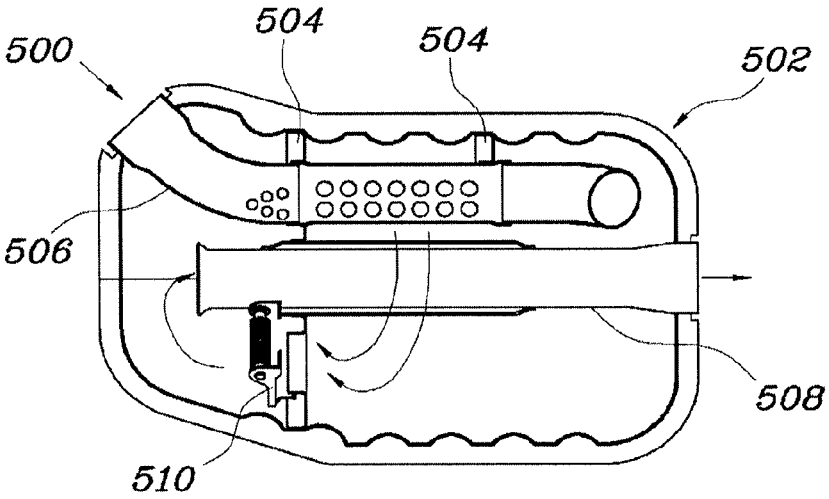
FIG. 1B (Related Art)

For reference, FIG. 5 and FIG. 6 compare the results of the conventional structure shown in FIG. 1 with the results of the structure according to the invention.

As described above, the structure according to the invention does not have a separate variable valve unlike the related art, and thus can reduce production cost and does not increase back pressure that is unnecessary in a low-medium speed range, thereby contributing to the increased power of the engine.

In addition, the inlet pipe IP communicates with the three chambers, including the first chamber C1, the second chamber C2 and the third chamber C3. Specifically, a first flow path L1 connects the holes A of the inlet pipe IP to the entrance of the outlet pipe OP inside the first chamber C1. A second flow path L2 connects the holes B of the inlet pipe IP to the holes C of the intermediate pipe MP inside the second chamber C2. A third flow path L3 connects the opening of the inlet pipe IP to the open end of the intermediate pipe MP inside the third chamber C3. A fourth flow path L4 connects the opening of the inlet pipe IP to the holes D of the outlet pipe OP inside the third chamber C3. These flow path structures can maximize the interference and amplification effects of the pulsation pressure of exhaust gas, thereby realizing a sporty sound effect of exhaust gas through the amplification of sound waves at 200 Hz.

Although the exemplary embodiments of the present invention have been described for illustrative purposes, those skilled in the art will appreciate that various modifications, additions and substitutions are possible, without departing from the scope and spirit of the present invention as disclosed in the accompanying claims.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler for a vehicle, comprising:

a housing which defines a space therein;

first and second baffles which partition the space inside the housing into first, second and third chambers which are sequentially arranged therein;

an inlet pipe which extends from one side of the housing through the first baffle and the second baffle to be connected to the third chamber through the first chamber and the second chamber such that exhaust gas is introduced from outside through the inlet pipe;

an intermediate pipe which connects between the first and third chambers through the first baffle and the second baffle and has a plurality of holes in a portion thereof which is placed in the second chamber; and an outlet pipe which sequentially extends through the first baffle and the second baffle from an first open end inside the first chamber, sequentially extends through the second baffle and the first baffle, sequentially extends through the first baffle and the second baffle, and then extends to the outside of the housing, such that the exhaust gas is discharged to the outside through the outlet pipe;

wherein the outlet pipe has a plurality of holes in a portion thereof which is exposed inside the third chamber before extending through the housing; and wherein the inlet pipe, the intermediate pipe, and the outlet pipe are configured such that the portions of the inlet and intermediate pipes which are placed in the first and second baffles are arranged parallel to each other, and a first open end of the inlet e and the holes of the outlet pipe are disposed inside the third chamber so as to be adjacent to each other without an obstacle spatially.

2. The muffler according to claim 1, wherein the inlet pipe has a plurality of holes in portions thereof which are respectively placed in the first and second chambers.

3. The muffler according to claim 2, wherein the outlet pipe linearly extends from one end in the first chamber so as to sequentially extend through the first baffle and the second baffle, is connected to a first U-shaped pipe section inside the third chamber, sequentially extends through the second baffle and the first baffle, is connected to a second U-shaped pipe section inside the first chamber, sequentially extends through the first baffle and the second baffle, and then extends to the outside through the housing.

4. The muffler according to claim 3, wherein the first open end of the outlet pipe and the holes of the inlet pipe are disposed inside the first chamber at positions which are spatially separated from each other by the second U-shaped pipe section of the outlet pipe.

* * * * *